US005607738A

United States Patent [19]

Bishop

[11] Patent Number: 5,607,738

[45] Date of Patent: Mar. 4, 1997

[54] MULTIPLE-PART CARBONLESS PRESSURE SEAL BUSINESS FORM ASSEMBLY

[75] Inventor: Gary Bishop, Clive, Iowa

[73] Assignee: Moore Business Forms, Inc., Grand Island, N.Y.

[21] Appl. No.: 521,028

[22] Filed: Aug. 29, 1995

[51] Int. Cl.[6] ..... B65D 27/10; B65D 27/34

[52] U.S. Cl. ..... 428/43; 229/314; 229/92.3; 229/92.1; 462/6

[58] Field of Search ..... 428/43; 229/314, 229/92.3, 92.1; 462/6

[56] References Cited

U.S. PATENT DOCUMENTS 3,016,308 1/1962 Macaulay ..... 428/402
3,429,827 2/1969 Ruus ..... 252/316
4,918,128 4/1990 Sakai ..... 524/450
5,092,514 3/1992 Van Malderghem et al. ..... 229/69
5,253,798 10/1993 Lombardo ..... 229/92.1

*Primary Examiner*—Alexander Thomas
*Attorney, Agent, or Firm*—Nixon & Vanderhye P.C.

[57] ABSTRACT

A mailer is comprised of multiple plies of carbonless paper secured one to the other along opposite edges by hot or cold adhesive. Pressure seal adhesive is applied along longitudinally and transversely extending tear strips of the intermediate assembly such that upon folding the plies about a medial scoreline, the pressure seal adhesives register with corresponding pressure seal adhesives on the opposite parts. SpeediSealer® equipment is used to apply pressure to the margins of the folded intermediate to adhere the parts to one another to form the mailer.

17 Claims, 3 Drawing Sheets

MULTIPLE-PART CARBONLESS PRESSURE SEAL BUSINESS FORM ASSEMBLY

TECHNICAL FIELD

The present invention relates to a business form assembly and particularly relates to a simplified two-part carbonless pressure seal mailer.

BACKGROUND

Multiple-part carbonless forms have been manufactured and used in the past. Such forms typically include microcapsules which are ruptured or burst upon application of pressure to form an image on an associated ply of the business form assembly. These forms have been extensively used for some considerable time (early efforts being disclosed in U.S. Pat. Nos. 3,429,827 and 3,016,308 of common assignee herewith) and have eliminated the need for additional layers of paper such as carbon paper interposed between the plies of the business form assembly. Application of substantial pressure is a prerequisite to use of the carbonless forms in order to provide the intelligent image. Typically, the plies of the form are secured to one another by using a hot melt or cold glue which does not require pressure to adhere the plies one to the other or sufficient pressure to obtain such adherence which would also rupture the microcapsules and form smudges on the carbonless paper.

Conventional mailers used in the Moore Business Forms, Inc. SpeediSealer®) equipment sold under the trademark SpeediSealer® have proven to be very simple and efficient in use. Typically, the forms are fed through a laser printer in sheet or continuous format with variable or non-variable printing or both being applied to one side or typically both sides. The forms are then burst, the tractor guide portions are slit and individual sheets are folded and pressure sealed. The use of pressure sealing adhesives and equipment is particularly effective for use in connection with forms which are folded and sealed subsequent to printing the variable and/or non-variable information on the form. Typically, where carbonless forms are used, the webs are preprinted with the variable and/or non-variable information and joined by hot or cold melt adhesives. Use of pressure seal adhesives for carbonless forms, however, was not previously considered practical, because of the necessity to apply substantial pressure to the pressure seal which would simultaneously cause smudging of the carbonless paper.

DISCLOSURE OF THE INVENTION

According to the present invention, a business form assembly is provided with variable and/or non-variable printing on the plies of the form with the plies being secured to one another by hot or cold glues and subsequently folded using pressure sealing techniques such as the SpeediSealer® equipment sold by Moore Business Forms, Inc., of common assignee herewith. It is only through the application of pressure along a peripheral portion of the folded forms that the areas of the carbonless paper containing the microcapsules are avoided and, hence, any smudges otherwise formed by the application of pressure are likewise avoided. Particularly, the present invention provides a multi-part carbonless pressure seal form wherein two or more plies preferably having variable and/or non-variable information preprinted on the plies are secured along their longitudinally extending margins by a hot melt or cold glue. The hot melt or cold glue lines are provided along the longitudinally extending tear strips. Pressure seal adhesive is applied in short, discontinuous strips along the transversely extending end edges of the form to secure by subsequent pressure sealing the plies to one another.

A transversely extending scoreline is formed intermediate, preferably medially, of the end edges of the plies whereby the plies can be folded about the scoreline. Along the transversely extending end edges of the inner ply, there are provided strips of pressure seal adhesive which, when the form is folded along the scoreline, lie in registration one with the other. Additionally, discontinuous strips are applied along the inner faces of the longitudinally extending tear strips of the inner ply at transversely spaced locations therealong and inwardly of the cold or hot glue. In this manner, when the form is folded about the transverse scoreline, the lines of pressure seal adhesive lie in registry one with the other. A window may be provided in the outer ply or through both plies to register with preprinted information on another of the plies.

Consequently, when the plies are folded about the intermediate scoreline, the strips of longitudinally transversely spaced pressure seal adhesive along the strips register with one another and the transversely extending discontinuous short pressure seal strips register one with the other. By passing the folded form through SpeediSealer® equipment, appropriate pressure is applied to the longitudinal and transversely extending margins without application of pressure interiorly of the margins whereby smudging or otherwise rupturing the microcapsules of the carbonless paper is avoided.

In a preferred embodiment according to the present invention, there is provided a business form assembly comprising a multi-ply business form including first and second plies, the first ply having longitudinally extending lines of perforation inset from opposite side edges of the first ply defining longitudinally extending tear strips along opposite sides of the first ply and transversely extending lines of perforations inset from opposite end edges of the first ply defining transverse tear strips extending between the longitudinally extending tear strips, the second ply having longitudinally extending lines of perforations inset from opposite side edges of the second ply defining longitudinally extending tear strips along opposite sides of the second ply and transversely extending lines of perforations inset from opposite end edges of the second ply defining transverse tear strips extending between the longitudinally extending tear strips of the second ply, the first and second plies being superposed one over another with the longitudinally and transversely extending perforations of the first and second plies, respectively, lying in registry with one another and the longitudinally and transversely extending tear strips, respectively, lying in registry with one another, tractor feed holes in the longitudinally extending tear strips with the feed holes of the longitudinally extending tear strips of the first ply lying in registry with the feed holes of the longitudinally extending tear strips of the second ply, lines of adhesive between the registering longitudinally extending tear strips of the first and second plies at a location between the registering longitudinally extending lines of perforations and the side edges on each side of the form for securing the plies to one another, the second ply having pressure seal adhesive along the longitudinally extending tear strips thereof on a face thereof remote from the first ply at locations between the longitudinally extending lines of perforations and the opposite side edges of the second ply, and along the transversely extending tear strips thereof on a face thereof remote from the first ply at locations between the transversely extending lines of perforations and the end edges of the second ply, a scoreline extending transversely along each of the first and second plies intermediate the opposite end edges thereof and in registry with one another to enable a first part of the first and second plies to be folded about the fold lines into registration with a second part of the first and second plies with the pressure seal adhesive along the longitudinal tear strips of the first and second parts in registry with one another and the pressure seal adhesive along the transversely extending tear strips in registry with one another whereby, upon application of pressure along the registering longitudinal and transversely extending tear strips, the first and second parts of the second ply being sealed to one another forming a mailer closed along end and side edges.

In a further preferred embodiment according to the present invention, there is provided a business form assembly comprising a carbonless multi-ply business form including first and second plies having longitudinally extending lines of perforation inset from opposite side edges thereof defining longitudinally extending tear strips along opposite sides of the form and transversely extending lines of perforations inset from opposite end edges thereof ply defining transverse tear strips extending between the longitudinally extending tear strips, lines of hot melt or cold adhesive between the first and second plies at locations between the longitudinally extending lines of perforations and the side edges on each side of the form for securing the plies to one another, the second ply having pressure seal adhesive along the longitudinally extending tear strips on a face thereof remote from the first ply at locations between the longitudinally extending lines of perforations and the opposite side edges of the form, and along the transversely extending tear strips on a face thereof remote from the first ply at locations between said transversely extending lines of perforations and the end edges of the second ply, a scoreline extending transversely along each of the first and second plies intermediate the opposite end edges thereof and in registry with one another to enable a first part of the first and second plies to be folded about the fold lines into registration with a second part of the first and second plies with the pressure seal adhesive along the longitudinal tear strips of the first and second parts in registry with one another and the pressure seal adhesive along the transversely extending tear strips in registry with one another whereby, upon application of pressure along the registering longitudinal and transversely extending tear strips, the first and second parts of the second ply are sealed to one another forming a mailer closed along end and side edges.

Accordingly, it is a primary object of the present invention to provide a multi-ply carbonless pressure seal business form assembly.

BEST MODE FOR CARRYING OUT THE INVENTION

Figure 1:
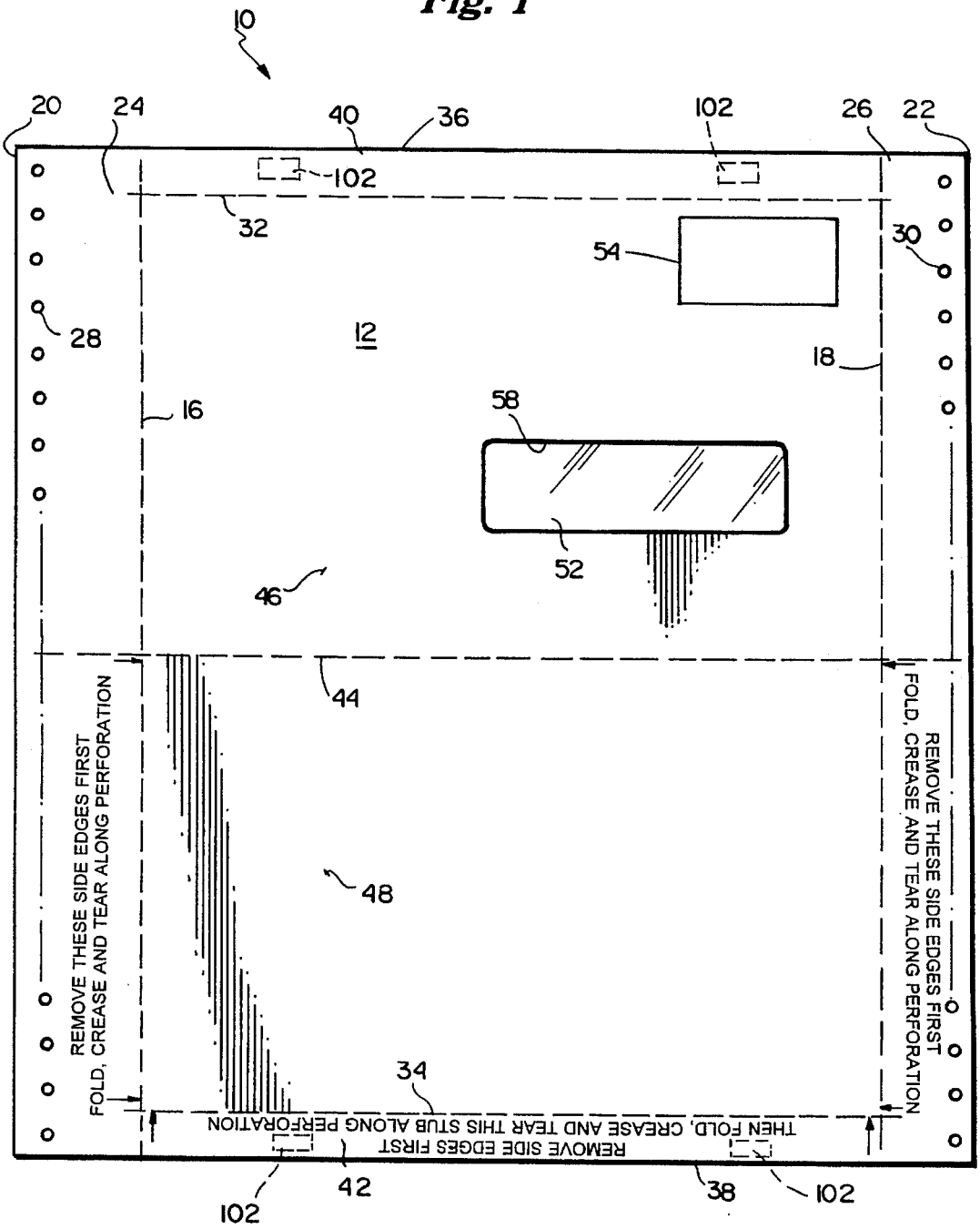
FIG. 1 is a top plan view of a multi-ply mailer intermediate its formation according to the present invention.
Figure 2:
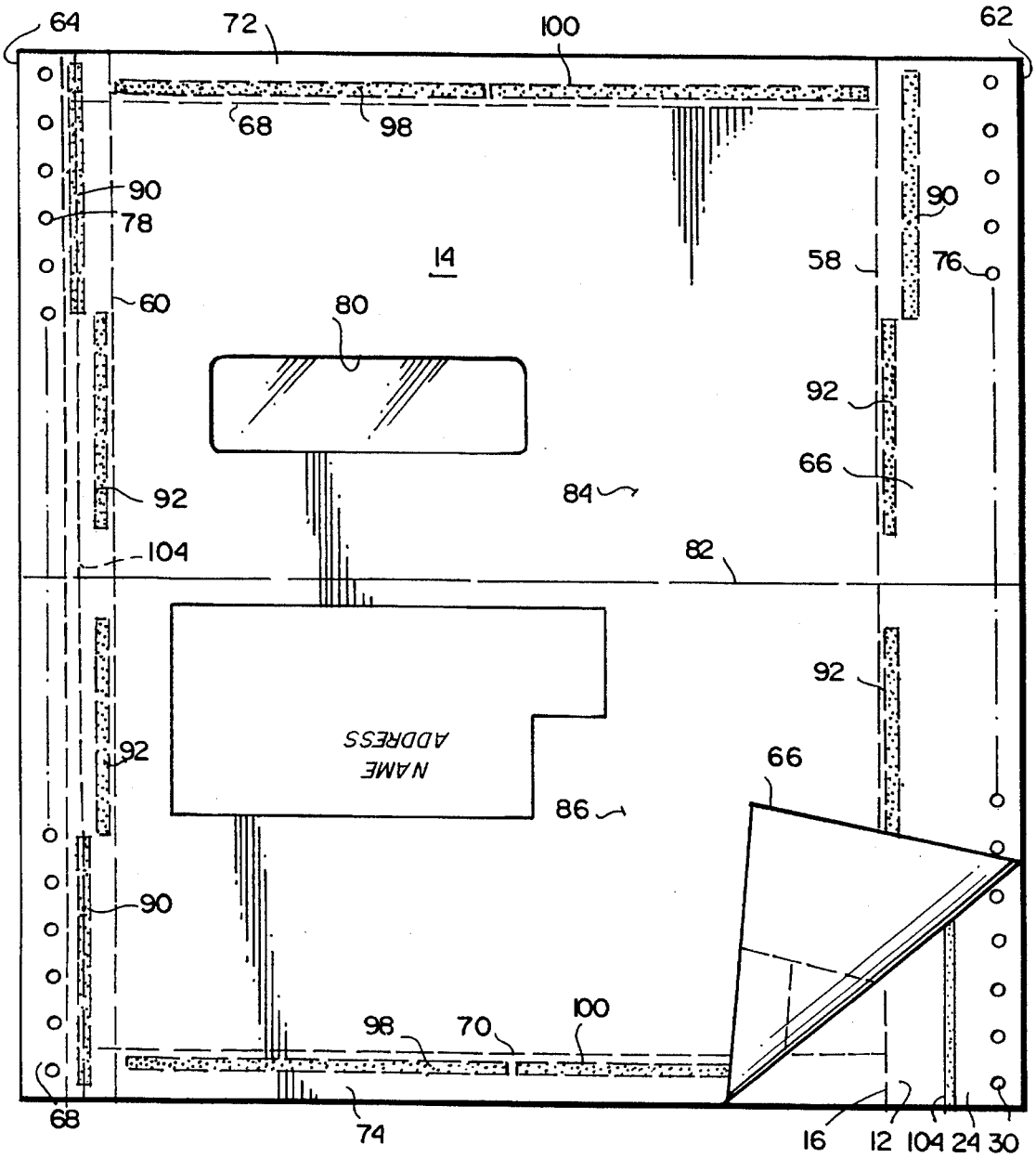
FIG. 2 is a bottom plan view of the multi-ply mailer intermediate illustrated in FIG. 1.
Figure 3:
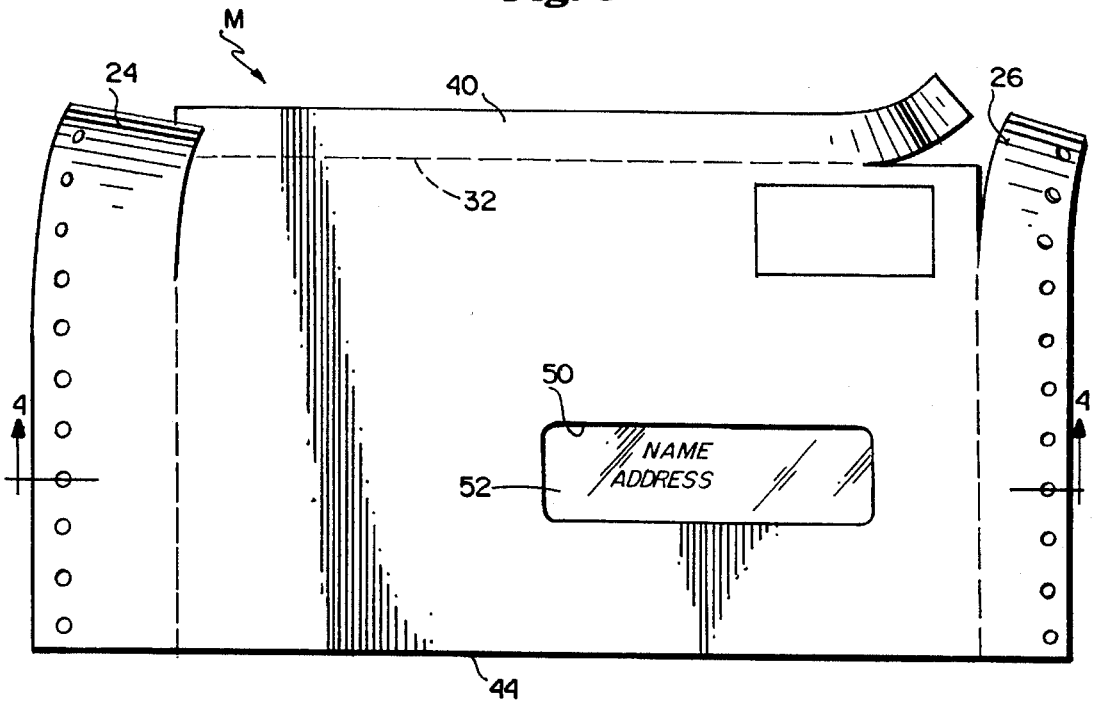
FIG. 3 is a plan view of the mailer hereof illustrating the manner of detachment of the longitudinal and transversely extending tear strips.
Figure 4:
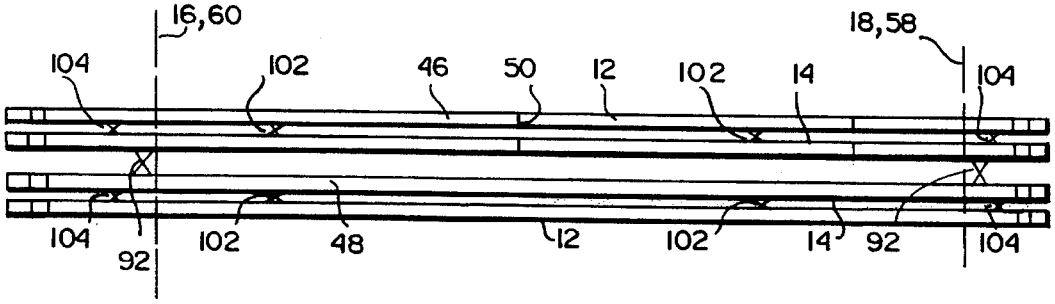
FIG. 4 is a side elevational view of the mailer illustrating the location of the lines of perforations and the adhesive strips.

Referring now to the drawings, particularly to FIGS. 1 and 2, there is illustrated a multi-ply business form assembly, generally designated 10, in an intermediate condition prior to forming a mailer M illustrated in FIG. 3. The multi-ply business form assembly intermediate 10 may comprise a number of plies and, in a preferred form, comprises a first ply 12 and a second ply 14 lying in registration one with the other. It will be appreciated that both plies 12 and 14 are formed of carbonless paper and may be preprinted with variable or non-variable information, or both, prior to being adhered one to the other and folded to form the mailer M. Additionally, it will be further appreciated that the plies 12 and 14 form part of continuous webs from which the plies have been burst after being adhered one to the other in the manner set forth in the ensuing description. The first ply 12 includes a plurality of longitudinally extending lines of perforations or weakenings 16 and 18 which extend in the direction of web travel. The lines of perforations 16 and 18 are inset from the opposite side edges 20 and 22, respectively, of the first ply 12 to define respective longitudinally extending tear strips 24 and 26. Tractor feed holes 28 and 30 are provided adjacent the side edges of ply 12 in tear strips 24 and 26, respectively. Ply 12 also has transversely extending tear strips 32 and 34 along opposite end edges 36 and 38 of the ply defining transversely extending tear strips 40 and 42, respectively. The lines of perforations 32 and 34 preferably extend to the longitudinally extending lines of perforations 16 and 18 but may extend to the side edges 20 and 22 as desired. Intermediate and preferably medially of the opposite end edges 36 and 38 is a transversely extending scoreline 44. Scoreline 44 extends between the opposite side edges 20 and 22 and defines first and second parts 46 and 48 of the first ply 12, respectively.

The first ply 12 may be provided with a window through which preprinted address information may appear when the plies are folded to form the mailer M. The window may or may not have a transparent patch such as patch 52 formed of glassine material. Additional preprinted information may appear along the outer face of ply 12 such as a stamp area 54, instructions for opening the mailer upon receipt, return address information and various other information such as mailing bar codes as needed.

Referring now to FIG. 2, there is illustrated the second ply 14 is which lies in registry with the first ply 12. Second ply 14 includes longitudinally extending lines of perforations 58 and 60 inset from the opposite side edges 62 and 64 of second ply 14. Lines of perforations 58 and 60 define longitudinally extending tear strips 66 and 68 which, when the plies 12 and 14 are aligned, lie in registration with tear strips 24 and 26, respectively. The lines of perforations 58 and 60 also lie in registration with the lines of perforations 16 and 18. Transversely extending lines of perforations 68 and 70 line inset from the opposite end edges of the second ply 14 defining transversely extending tear strips 72 and 74 between the longitudinally extending tear strips 66 and 68. Upon registration of the plies, it will be appreciated that the lines of perforations 68 and 70 register with the lines of perforations 32 and 34, respectively, of the first ply 12 and the tear strips 72 and 74 lie in registration with the tear strips 40 and 42, respectively. Similar tractor feed holes 76 and 78 are provided along the longitudinally extending tear strips in registration with the tractor feed holes 28 and 30 upon registration of the plies.

The second ply 14 also includes a window 80 which lies in registration with the window 50 of the first ply. A transversely extending scoreline 82 may also be provided intermediate and preferably medially of the second ply 14 for registration with the scoreline 44 of the first ply. The scoreline 82 divides the second ply into first and second parts 84 and 86, respectively, which register with the first and second parts 46 and 48, respectively, of the first ply upon registration of the plies. The second ply 14 may be provided with preprinted variable or non-variable information, or both, as necessary and desirable. For example, address information which appear through the registering windows 50 and 80 of the first and second plies upon formation of the mailer may be preprinted on the second part 86.

The plies 12 and 14 are formed with carbonless coatings whereby, upon application of substantial pressure on one of the plies, an image is transferred onto the other of the plies. Microcapsules of image forming or generating materials may be used, e.g., in accordance with well-known carbonless paper technology, such as described and illustrated in U.S. Pat. Nos. 3,016,308 and 3,429,827, the disclosures of which are incorporated herein by reference.

Pressure seal adhesive is applied along the inner surface of the interior ply 14 of the mailer M. The pressure seal adhesive may be of the type described and illustrated in U.S. Pat. No. 4,918,218. Particularly, discontinuous elongated strips of pressure seal adhesive 90 and 92 are provided along the longitudinally extending tear strips 66 and 68, respectively. The pressure seal strips 90 and 92 are transversely offset one from the other along each of the tear strips and are provided in each of the first and second parts 84 and 86 of the tear strips, respectively, such that, upon folding the plies about the scorelines 44 and 82, the pressure seal adhesive strips 90 of the first part 84 lie in registration with the pressure seal adhesive strips 90 of the second part 86 and the pressure seal adhesive strips 92 of the tear strips of the first part 84 lie in registration with the pressure seal adhesive strips 92 of the second part 86. This type of pressure seal adhesive pattern is described and illustrated in U.S. Pat. No. 5,253,798, of common assignee herewith. Further, transversely extending strips of pressure seal adhesive 98 and 100 are provided along each of the end tear strips 72 and 74, respectively, such that upon folding the second ply 14 about scoreline 82, pressure seal strips 98 lie in registration one with the other and strips 100 lie in registration with one another. Still further, short discrete lengths 102 of pressure seal adhesive are applied to facing surfaces of the tear strips 40, 72 and 42, 74 to lie in registration one with the other between the plies for securing the end margins of the plies to one another.

A hot glue or cold adhesive 104 is applied along the surface of the tear strips of one of the plies prior to registration so that the plies can be secured one to the other along their longitudinally extending edges. Thus, the webs from which the plies are formed are registered one with the other and the longitudinally extending lines of cold or hot melt adhesive 104 adhere the plies one to the other along the longitudinally extending tear strips. To complete the formation of the mailer, the plies are folded about the registering scorelines 44 and 82 such that the pressure seal adhesives 90, 92 of the first part 84 lie in registration with the pressure seal adhesive 90, 92 on the second part 86 of the second ply. Additionally, the pressure seal adhesive strips 98 and 100 along the transversely extending tear strips lie in registration with one another, respectively.

By passing the edges of the folded plies through SpeediSealer® equipment, the pressure seal adhesive adheres the first and second parts of the second ply to one another along the longitudinal and transversely extending edges. Note also that the short lengths 102 of pressure seal adhesive between the plies along the transversely extending tear strips are likewise secured to one another, thus closing the area between the plies. The SpeediSealer®) equipment may be of the type such that the marginal edges of the folded plies are first passed through SpeediSealer® equipment to secure the plies in the folded mailer configuration with the mailer then being rotated 90° to pass the transversely extending tear strips through SpeediSealer® equipment to complete securement of the plies to one another and the formation of the mailer.

It will be appreciated that the mailer M thus formed may be forwarded to a recipient and opened by the recipient by tearing along the registering longitudinal tear strips and also along the transversely extending tear strips whereby the portions within the longitudinally extending lines of perforation 16, 18 and 58, 60 of the first and second plies, respectively, and also within the registering transversely extending line of perforations 32, 34 and 68, 70, respectively, enables the interior portions of the plies to be separated one from the other. Consequently, the recipient may review the information on the interior ply, complete any requested information and return the second ply to the sender in a separate envelope, retaining the first ply for the recipient's records with the information imprinted thereon as a result of using carbonless paper for the plies.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A business form assembly comprising:

a multi-ply business form including first and second plies, said first ply having longitudinally extending lines of perforation inset from opposite side edges of said first ply defining longitudinally extending tear strips along opposite sides of said first ply and transversely extending lines of perforations inset from opposite end edges of said first ply defining transverse tear strips extending between said longitudinally extending tear strips;

said second ply having longitudinally extending lines of perforations inset from opposite side edges of said second ply defining longitudinally extending tear strips along opposite sides of said second ply and transversely extending lines of perforations inset from opposite end edges of said second ply defining transverse tear strips extending between the longitudinally extending tear strips of the second ply;

said first and second plies being superposed one over another with said longitudinally and transversely extending perforations of said first and second plies, respectively, lying in registry with one another and said longitudinally and transversely extending tear strips, respectively, lying in registry with one another;

tractor feed holes in said longitudinally extending tear strips with the feed holes of the longitudinally extending tear strips of said first ply lying in registry with the feed holes of the longitudinally extending tear strips of said second ply;

lines of adhesive between said registering longitudinally extending tear strips of said first and second plies at a location between said registering longitudinally extending lines of perforations and said side edges on each side of the form for securing said plies to one another;

said second ply having pressure seal adhesive along the longitudinally extending tear strips thereof on a face thereof remote from said first ply at locations between said longitudinally extending lines of perforations and said opposite side edges of said second ply, and along said transversely extending tear strips thereof on a face thereof remote from said first ply at locations between said transversely extending lines of perforations and said end edges of said second ply;

a scoreline extending transversely along each said first and second plies intermediate the opposite end edges thereof and in registry with one another to enable a first part of said first and second plies to be folded about said fold lines into registration with a second part of said first and second plies with the pressure seal adhesive along the longitudinal tear strips of said first and second parts in registry with one another and the pressure seal adhesive along the transversely extending tear strips in registry with one another whereby, upon application of pressure along said registering longitudinal and transversely extending tear strips, said first and second parts of said second ply are sealed to one another forming a mailer closed along end and side edges.

2. A business form assembly according to claim 1 wherein said pressure seal adhesive along the longitudinal tear strips of each of said first and second parts of said second ply comprises lines of adhesive transversely offset from one another.

3. A business form assembly according to claim 1 including a window through said first ply in one of said first and second parts thereof, and address information on one of said first and second parts of said second ply for viewing through said window when said plies are folded to form said mailer.

4. A business form assembly according to claim 1 including a window through registering parts of said first and second plies, and address information on another part of said second ply for viewing through said window when said plies are folded to form said mailer.

5. A business form assembly according to claim 1 wherein said first and second plies are formed of carbonless paper.

6. A business form assembly according to claim 1 including pressure seal adhesive between said transversely extending tear strips of said first and second plies along opposite end edges thereof.

7. A business form assembly according to claim 1 wherein said first and second plies are formed of carbonless paper, including pressure seal adhesive between said transversely extending tear strips of said first and second plies along opposite end edges thereof, said pressure seal adhesive along the longitudinal tear strips of each of said first and second parts of said second ply comprising lines of adhesive transversely offset from one another.

8. A business form assembly according to claim 7 including a window through said first ply in one of said first and second parts thereof, and address information on one of said first and second parts of said second ply for viewing through said window when said plies are folded to form said mailer.

9. A business form assembly according to claim 7 including a window through registering parts of said first and second plies, and address information on another part of said second ply for viewing through said window when said plies are folded to form said mailer.

10. A business form assembly comprising:

a carbonless multi-ply business form including first and second plies having longitudinally extending lines of perforation inset from opposite side edges thereof defining longitudinally extending tear strips along opposite sides of said form and transversely extending lines of perforations inset from opposite end edges thereof defining transverse tear strips extending between said longitudinally extending tear strips;

lines of hot melt or cold adhesive between said first and second plies at locations between said longitudinally extending lines of perforations and said side edges on each side of the form for securing said plies to one another;

said second ply having pressure seal adhesive along the longitudinally extending tear strips on a face thereof remote from said first ply at locations between said longitudinally extending lines of perforations and said opposite side edges of said form, and along said transversely extending tear strips on a face thereof remote from said first ply at locations between said transversely extending lines of perforations and said end edges of said second ply;

a scoreline extending transversely along each said first and second plies intermediate the opposite end edges thereof and in registry with one another to enable a first part of said first and second plies to be folded about said fold lines into registration with a second part of said first and second plies with the pressure seal adhesive along the longitudinal tear strips of said first and second parts in registry with one another and the pressure seal adhesive along the transversely extending tear strips in registry with one another whereby, upon application of pressure along said registering longitudinal and transversely extending tear strips, said first and second parts of said second ply are sealed to one another forming a mailer closed along end and side edges.

11. A business form assembly according to claim 10 wherein said pressure seal adhesive along the longitudinal tear strips of each of said first and second parts of said second ply comprises lines of adhesive transversely offset from one another.

12. A business form assembly according to claim 10 including a window through said first ply in one of said first and second parts thereof, and address information on one of said first and second parts of said second ply for viewing through said window when said plies are folded to form said mailer.

13. A business form assembly according to claim 10 including a window through registering parts of said first and second plies, and address information on another part of said second ply for viewing through said window when said plies are folded to form said mailer.

14. A business form assembly according to claim 10 including pressure seal adhesive between said transversely extending tear strips of said first and second plies along opposite end edges thereof.

15. A business form assembly according to claim 10 including pressure seal adhesive between said transversely extending tear strips of said first and second plies along opposite end edges thereof, said pressure seal adhesive along the longitudinal tear strips of each of said first and second parts of said second ply comprising lines of adhesive transversely offset from one another.

16. A business form assembly according to claim 15 including a window through said first ply in one of said first and second parts thereof, and address information on one of said first and second parts of said second ply for viewing through said window when said plies are folded to form said mailer.

17. A business form assembly according to claim 15 including a window through registering parts of said first and second plies, and address information on another part of said second ply for viewing through said window when said plies are folded to form said mailer.

* * * * *